US011209782B2

(12) United States Patent
Jones

(10) Patent No.: US 11,209,782 B2
(45) Date of Patent: Dec. 28, 2021

(54) AUDIBLE WRISTWATCH ASSEMBLY

(71) Applicant: Wendell Jones, S Holland, IL (US)

(72) Inventor: Wendell Jones, S Holland, IL (US)

( * ) Notice: Subject to any disclaimer, the term of this patent is extended or adjusted under 35 U.S.C. 154(b) by 338 days.

(21) Appl. No.: 16/268,974

(22) Filed: Feb. 6, 2019

(65) Prior Publication Data

US 2020/0249634 A1 Aug. 6, 2020

(51) Int. Cl.

| | |
|---|---|
| ***G04G 21/06*** | (2010.01) |
| ***G04G 17/08*** | (2006.01) |
| *A44C 5/20* | (2006.01) |
| *A44C 5/00* | (2006.01) |
| *A44C 5/14* | (2006.01) |

(52) U.S. Cl.

CPC ..... *G04G 21/06* (2013.01); *G04G 17/08* (2013.01); *A44C 5/0053* (2013.01); *A44C 5/147* (2013.01); *A44C 5/2019* (2013.01)

(58) Field of Classification Search

CPC ..... G04G 21/06; G04G 17/08; G04G 9/00; G04G 9/08; G04G 13/00; A44C 5/0053; A44C 5/147; A44C 5/2019; G04C 21/14; A45F 5/00; A45F 2200/0516; A45F 2005/008; A45F 2200/0508

USPC ..... 368/63; 200/43.18, 43.19

See application file for complete search history.

(56) References Cited

U.S. PATENT DOCUMENTS

| | | | | |
|---|---|---|---|---|
| 3,998,045 | A * | 12/1976 | Lester | G04G 13/00 368/63 |
| 4,312,057 | A | 1/1982 | Kume | |
| 4,421,416 | A | 12/1983 | Hashimoto | |
| 4,444,515 | A | 4/1984 | Clark | |
| 4,509,667 | A * | 4/1985 | Meldrum | A45F 5/00 224/222 |
| 4,531,841 | A | 7/1985 | Puff | |
| 5,150,913 | A * | 9/1992 | Hoelzl | A63B 9/0885 200/302.2 |
| D369,751 | S | 5/1996 | Boyer | |
| 6,307,813 | B1 * | 10/2001 | Leggio | G04G 9/00 368/63 |
| 6,546,603 | B1 * | 4/2003 | Wang | A44B 18/0023 24/265 WS |
| 6,665,233 | B2 | 12/2003 | Cosgrove | |
| 8,634,278 | B1 * | 1/2014 | Nguyen | G04C 21/14 368/63 |
| 9,351,551 | B2 * | 5/2016 | Morgan | A45F 5/00 |
| 9,615,650 | B2 * | 4/2017 | Soriano | A45F 5/00 |
| 10,132,340 | B2 * | 11/2018 | Russell-Clarke | F16B 1/00 |

* cited by examiner

*Primary Examiner* — Edwin A. Leon

(57) ABSTRACT

An audible wristwatch assembly for alerting a blind user of the time of day and calendar date includes a strap that is worn around a user's wrist. The strap is extended through a housing and the housing has a recess therein. An electronic clock is positioned within the housing to track the time of day and the calendar date. A speaker is coupled to the housing to emit audible sounds outwardly from the housing. An announcement button is movably coupled to the housing, and the announcement button is positioned in the recess to inhibit the announcement button from being inadvertently depressed. The speaker audibly emits the time of day and the calendar date when the announcement button is depressed to alert the user to the time of day and the calendar date.

7 Claims, 4 Drawing Sheets

AUDIBLE WRISTWATCH ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to wristwatch devices and more particularly pertains to a new wristwatch device for alerting a blind user of the time of day and calendar date.

BRIEF SUMMARY OF THE INVENTION

An embodiment of the disclosure meets the needs presented above by generally comprising a strap that is worn around a user's wrist. The strap is extended through a housing and the housing has a recess therein. An electronic clock is positioned within the housing to track the time of day and the calendar date. A speaker is coupled to the housing to emit audible sounds outwardly from the housing. An announcement button is movably coupled to the housing, and the announcement button is positioned in the recess to inhibit the announcement button from being inadvertently depressed. The speaker audibly emits the time of day and the calendar date when the announcement button is depressed to alert the user to the time of day and the calendar date.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
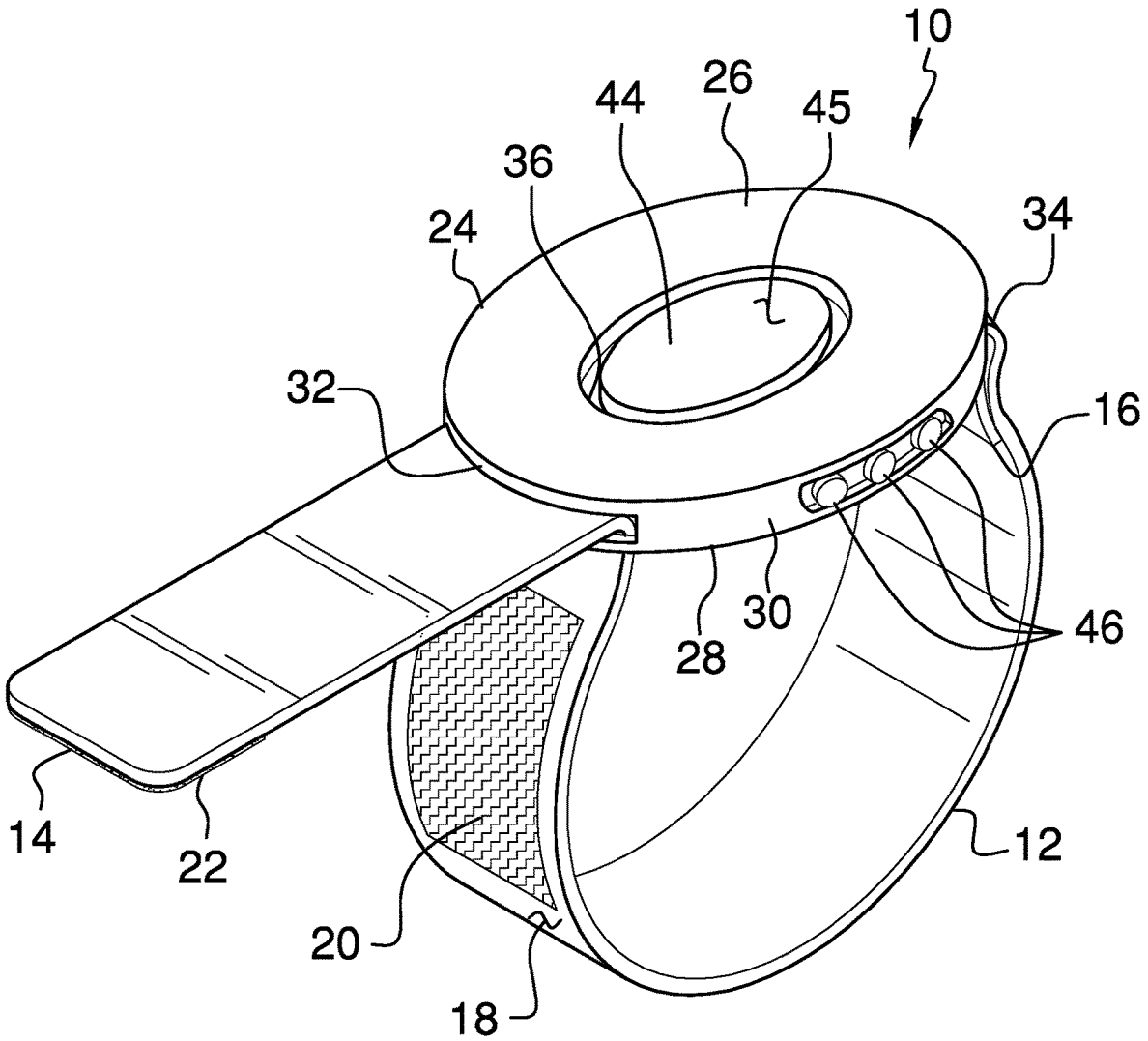
FIG. 1 is a top perspective view of a audible wristwatch assembly according to an embodiment of the disclosure.
Figure 2:
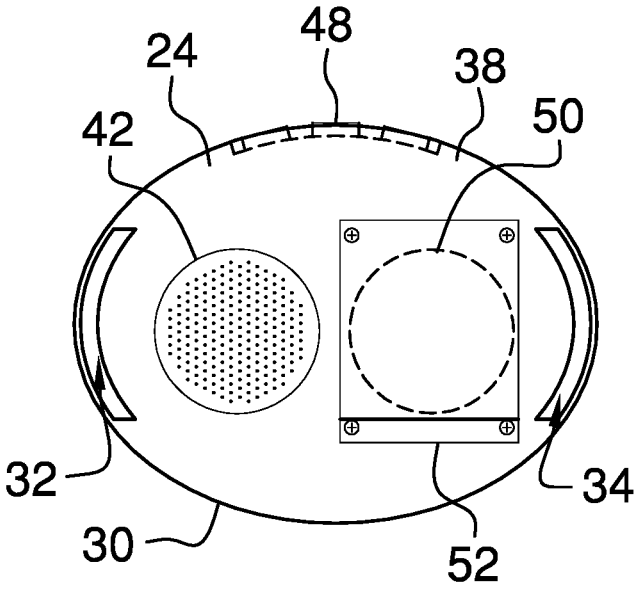
FIG. 2 is a bottom view of a housing of an embodiment of the disclosure.
Figure 3:
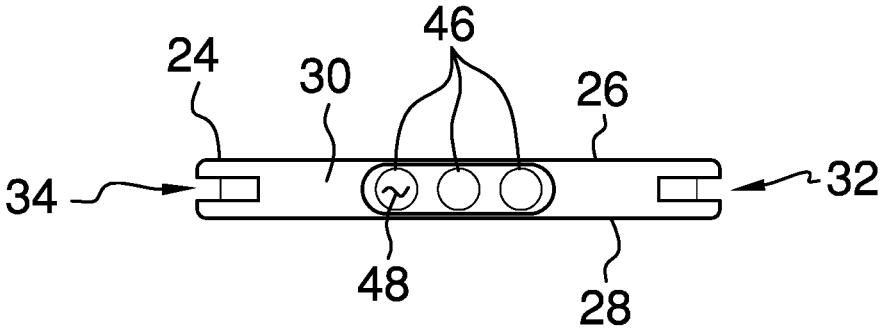
FIG. 3 is a right side view of a housing of an embodiment of the disclosure.
Figure 4:
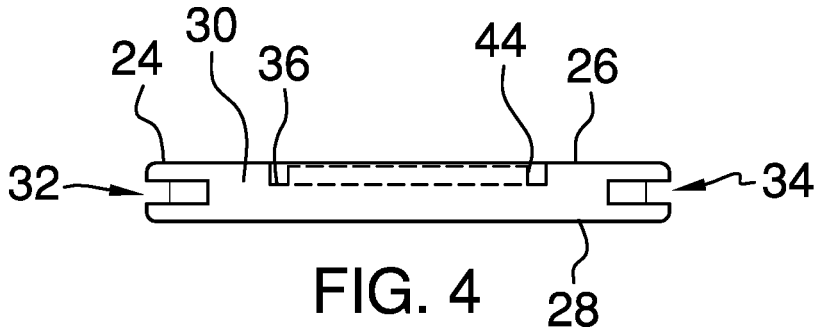
FIG. 4 is a left side phantom view of an embodiment of the disclosure.

With reference now to the drawings, and in particular to FIGS. 1 through 6 thereof, a new wristwatch device embodying the principles and concepts of an embodiment of the disclosure and generally designated by the reference numeral 10 will be described.

As best illustrated in FIGS. 1 through 6, the audible wristwatch assembly 10 generally comprises a strap 12 is matable to itself to form a closed loop. In this way the strap 12 can be worn around a user's wrist, and the user may be a blind person. The strap 12 has a first end 14, a second end 16 and a first surface 18 extending therebetween. A first mating member 20 is coupled to the first surface 18 and the first mating member 20 is spaced from the first end 14. A second mating member 22 is coupled to the first surface 18 and the second mating member 22 is positioned between the first end 14 and the first mating member 20. Moreover, the second mating member 22 releasably engages the first mating member 20. Each of the first 20 and second 22 mating members may be hook and loop fasteners or the like.

A housing 24 is included and the strap 12 is extendable through the housing 24 thereby facilitating the housing 24 to be retained on the user's wrist. The housing 24 has a top wall 26, a bottom wall 28 and a perimeter wall 30 extending therebetween, and the perimeter wall 30 is arcuate about an axis extending through the top 26 and bottom 28 walls such that the housing 24 has a rounded shape. The housing 24 may be elongated such that the housing 24 has an ovoid cross section taken along the axis.

The housing 24 has a first slot 32 extending through the bottom wall 28 and the perimeter wall 30. Additionally, the housing 24 has a second slot 34 extending through the bottom wall 28 and the perimeter wall 30. The first slot 32 is positioned on an opposite side of the housing 24 from the second slot 34. The second end 16 of the strap 12 extends through the second slot 34 and the second end 16 of the strap 12 is bounded to the strap 12, thereby retaining the strap 12 in the housing 24.

The first end 14 of the strap 12 is extendable through the first slot 32 when the strap 12 has been wrapped around the user's wrist. Additionally, the second mating member 22 is manipulated to engage the first mating member 20 to close the strap 12 around the user's wrist to retain the housing 24 on the user's wrist in the convention of a wrist watch.

Additionally, the bottom wall 28 of the housing 24 rests on the user's wrist when the strap 12 is worn around the user's wrist. The top wall 26 has a recess 36 extending downwardly toward the bottom wall 28.

A control circuit 38 is positioned within the housing 24 and the control circuit 38 receives an announcement input. Additionally, the control circuit 38 includes voice synthesizing circuitry. An electronic clock 40 is positioned within the housing 24 to track the time of day and the calendar date and the electronic clock 40 is electrically coupled to the control circuit 38. A speaker 42 is coupled to the housing 24 and the speaker 42 emits audible sounds outwardly from the housing 24 when the speaker 42 is turned on. The speaker 42 is electrically coupled to the control circuit 38 and the speaker 42 is turned on to emit the audible sounds when the control circuit 38 receives the announcement input. In this way the speaker 42 audibly announces the time of day and the calendar date to the user.

An announcement button 44 is movably coupled to the housing 24 and the announcement button 44 is positioned in the recess 36. A top surface 45 of the announcement button lies on a plane that is below the top wall 26 of the housing 24. Thus, the announcement button 44 is inhibited from being inadvertently depressed. The announcement button 44 is electrically coupled to the control circuit 38 and the control circuit 38 receives the announcement input when the announcement button 44 is depressed. A plurality of control buttons 46 is each of the movably coupled to the housing 24. Moreover, each of the control buttons 46 is recessed into the perimeter wall 30 of the housing 24 such that an exposed surface 48 of each of the control buttons 46 is spaced outwardly beyond the perimeter wall 30. Each of the control buttons 46 is electrically coupled to the control circuit 38 and each of the control buttons 46 controls operational parameters of the electronic clock 40, such as programming the time of day, the calendar date and other functions that are common to electronic clocks.

Figure 5:
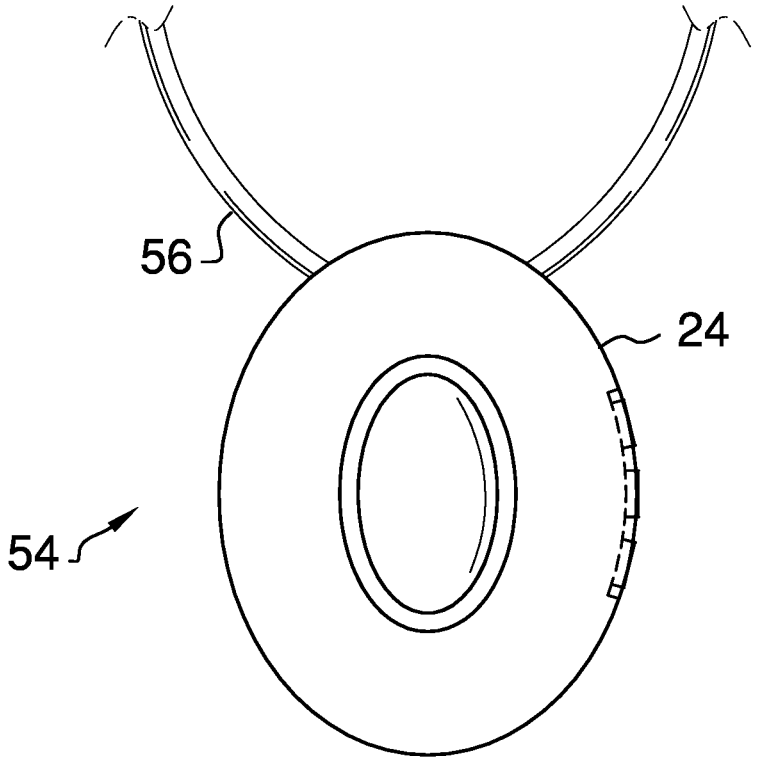
FIG. 5 is a perspective view of an alternative embodiment of the disclosure.
Figure 6:
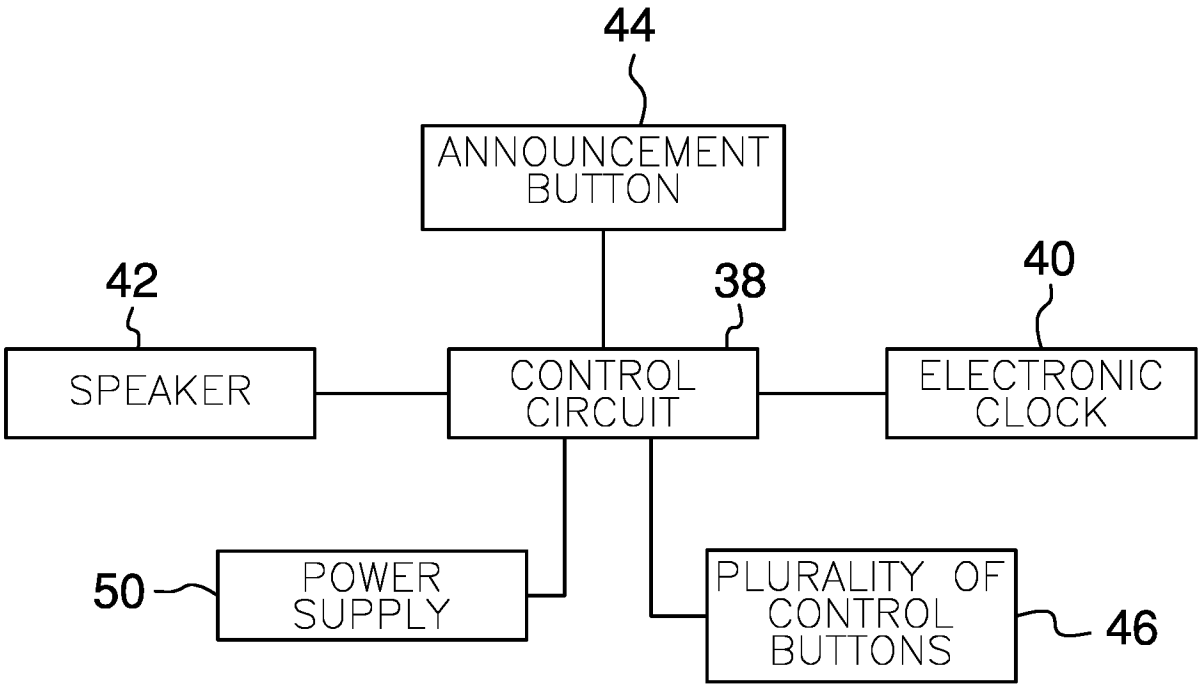
FIG. 6 is a schematic view of an alternative embodiment of the disclosure.

A power supply 50 is positioned in the housing 24, the power supply 50 is electrically coupled to the control circuit 38 and the power supply 50 comprises at least one battery. A battery cover 52 is removably coupled to the bottom wall 28 of the housing 24 and the power supply 50 is positioned behind the battery cover 52. A transceiver may be provided, the transceiver may be positioned in the housing 24 and the transceiver may be electrically coupled to the control circuit 38. Additionally, the transceiver may be in wireless electrical communication with a global positioning system for identifying the physical location of the housing 24. In this way the user can be located by another individual if the user becomes lost or disoriented. In an alternative embodiment 54 as shown in FIG. 5, the housing 24 may be suspended from a necklace 56 or the like.

In use, the strap 12 is wrapped around the user's wrist, the first end 14 of the strap 12 is inserted through the first slot 32 in the housing 24 and the first mating member 20 is engaged to the second mating member 22. The user depresses the announcement button 44 thereby turning the speaker 42 on to announce the time of day and the calendar date. In this way the blind user can be notified of the time of day and the calendar date. Additionally, the blind user can cope with symptoms of non-24 by being able to have the time of day and the calendar date available at all times.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An audible wristwatch assembly being configured to announce the date and time fir a blind user, said assembly comprising:

a strap being matable to itself to form a closed loop wherein said strap is configured to be worn around a user's wrist;

a housing having said strap being extended therethrough wherein said housing is configured to be retained on the user's wrist, said housing having a recess therein, said recess being elliptical, a length of a minor axis of said recess being greater than a depth of said recess;

an electronic clock being positioned within said housing wherein said electronic clock is configured to track the time of day and the calendar date;

a speaker being coupled to said housing wherein said speaker is configured to emit audible sounds outwardly from said housing;

an announcement button being movably coupled to said housing, said announcement button being positioned in said recess with a top surface of said announcement button being positioned adjacent, parallel to, and below a plane in which a top wall of said housing lies, wherein said announcement button is configured to be inhibited from being inadvertently depressed, said speaker audibly emitting the time of day and the calendar date when said announcement button is depressed wherein said speaker is configured to alert the user to the time of day and the calendar date;

said strap has a first end, a second end and a first surface extending therebetween;

said assembly further comprises a first mating member being coupled to said first surface, said first mating member being spaced from said first end;

said assembly further comprises a second mating member being coupled to said first surface, said second mating member being positioned between said first end and said first mating member, said second mating member releasably engaging said first mating member;

said housing having said top wall, a bottom wall and a perimeter wall extending therebetween, said perimeter wall being arcuate about an axis extending through said top and bottom walls such that said housing has a rounded shape;

said housing having a first slot extending through said bottom wall and said perimeter wall;

said housing having a second slot extending through said bottom wall and said perimeter wall, said first slot being positioned on an opposite side of said housing from said second slot; and said second end of said strap extending through said second slot having said second end of said strap being bounded to said strap such that said strap is coupled to said housing.

2. The assembly according to claim 1, wherein said first end of said strap is extendable through said first slot wherein said strap is configured to be wrapped around the user's wrist, said second mating member being manipulated to engage said first mating member wherein said strap is configured to be closed around the user's wrist having said bottom wall of said housing resting on the user's wrist, said top wall having said recess extending downwardly therein.

3. The assembly according to claim 1, further comprising a control circuit being positioned within said housing, said control circuit receiving an announcement input, said control circuit including voice synthesizing circuitry.

4. The assembly according to claim 3, wherein:

said announcement button is electrically coupled to said control circuit, said control circuit receiving said announcement input when said announcement button is depressed; and said speaker is electrically coupled to said control circuit, said speaker being turned on to emit audible sounds when said control circuit receives said announcement input wherein said speaker is configured to audibly announce the time of day and the calendar date to the user.

5. The assembly according to claim 3, further comprising a plurality of control buttons, each of said control buttons being movably coupled to said housing, each of said control buttons being recessed into said perimeter wall of said housing such that an exposed surface of each of said control buttons is spaced outwardly beyond said perimeter wall, each of said control buttons being electrically coupled to said control circuit, each of said control buttons controlling operational parameters of said electronic clock.

6. The assembly according to claim 3, further comprising a power supply being positioned in said housing, said power supply being electrically coupled to said control circuit, said power supply comprising at least one battery.

7. An audible wristwatch assembly being configured to announce the date and time for a blind user, said assembly comprising:

a strap being matable to itself to form a closed loop wherein said strap is configured to be worn around a user's wrist, said strap having a first end, a second end and a first surface extending therebetween;

a first mating member being coupled to said first surface, said first mating member being spaced from said first end;

a second mating member being coupled to said first surface, said second mating member being positioned between said first end and said first mating member, said second mating member releasably engaging said first mating member;

a housing having said strap being extended therethrough wherein said housing is configured to be retained on the user's wrist, said housing having a recess therein, said recess being elliptical, a length of a minor axis of said recess being greater than a depth of said recess, said housing having a top wall, a bottom wall and a perimeter wall extending therebetween, said perimeter wall being arcuate about an axis extending through said top and bottom walls such that said housing has a rounded shape, said housing having a first slot extending through said bottom wall and said perimeter wall, said housing having a second slot extending through said bottom wall and said perimeter wall, said first slot being positioned on an opposite side of said housing from said second slot, said second end of said strap extending through said second slot having said second end of said strap being bounded to said strap such that said strap is coupled to said housing, said first end of said strap being extendable through said first slot wherein said strap is configured to be wrapped around the user's wrist, said second mating member being manipulated to engage said first mating member wherein said strap is configured to be closed around the user's wrist having said bottom wall of said housing resting on the user's wrist, said top wall having said recess extending downwardly therein;

a control circuit being positioned within said housing, said control circuit receiving an announcement input, said control circuit including voice synthesizing circuitry;

an electronic clock being positioned within said housing wherein said electronic clock is configured to track the time of day and the calendar date, said electronic clock being electrically coupled to said control circuit;

a speaker being coupled to said housing wherein said speaker is configured to emit audible sounds outwardly from said housing, said speaker being electrically coupled to said control circuit, said speaker being turned on to emit audible sounds when said control circuit receives said announcement input wherein said speaker is configured to audibly announce the time of day and the calendar date to the user;

an announcement button being movably coupled to said housing, said announcement button being positioned in said recess with a top surface of said announcement button being positioned adjacent, parallel to, and below a plane in which a top wall of said housing lies, said announcement button being electrically coupled to said control circuit, said control circuit receiving said announcement input when said announcement button is depressed;

a plurality of control buttons, each of said control buttons being movably coupled to said housing, each of said control buttons being recessed into said perimeter wall of said housing such that an exposed surface of each of said control buttons is spaced outwardly beyond said perimeter watt, each of said control buttons being electrically coupled to said control circuit, each of said control buttons controlling operational parameters of said electronic clock; and a power supply being positioned in said housing, said power supply being electrically coupled to said control circuit, said power supply comprising at least one battery.

* * * * *